US008826819B2

(12) United States Patent
Elter et al.

(10) Patent No.: US 8,826,819 B2
(45) Date of Patent: Sep. 9, 2014

(54) METHOD FOR CONTROLLING INKING UNITS AND/OR DAMPENING UNITS

(75) Inventors: Peter Elter, Mühlhausen (DE); Nikolaus Pfeiffer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1007 days.

(21) Appl. No.: 12/546,398

(22) Filed: Aug. 24, 2009

(65) Prior Publication Data

US 2010/0064922 A1 Mar. 18, 2010

(30) Foreign Application Priority Data

Aug. 22, 2008 (DE) ..... 10 2008 039 408

(51) Int. Cl.
*B41F 33/00* (2006.01)
*B41F 31/04* (2006.01)

(52) U.S. Cl.
CPC ..... *B41F 33/0036* (2013.01); *B41F 33/0045* (2013.01); *Y10S 101/47* (2013.01); *Y10S 101/45* (2013.01)
USPC ..... 101/484; 101/365; 101/DIG. 47; 101/DIG. 45

(58) Field of Classification Search
USPC ..... 101/365, 483, 484, 485, DIG. 45, 101/DIG. 47
See application file for complete search history.

(56) References Cited

U.S. PATENT DOCUMENTS

| | | | | |
|---|---|---|---|---|
| 5,170,711 | A | 12/1992 | Maier et al. | |
| 5,697,033 | A * | 12/1997 | Ichikawa et al. | 399/310 |
| 5,907,999 | A * | 6/1999 | Lusar et al. | 101/484 |
| 5,967,049 | A * | 10/1999 | Seymour et al. | 101/484 |
| 6,230,622 | B1 | 5/2001 | Dilling | |
| 6,373,964 | B1 | 4/2002 | Geissler et al. | |
| 6,705,229 | B2 | 3/2004 | Frankenberger | |
| 6,715,424 | B2 * | 4/2004 | Yamamoto et al. | 101/484 |
| 6,742,452 | B2 * | 6/2004 | Mayer et al. | 101/365 |
| 7,634,964 | B2 * | 12/2009 | Masuch | 101/365 |
| 2008/0011176 | A1 * | 1/2008 | Masuch | 101/491 |
| 2008/0236430 | A1 * | 10/2008 | Elter et al. | 101/484 |

FOREIGN PATENT DOCUMENTS

| | | | |
|---|---|---|---|
| DE | 4122794 | A1 | 1/1993 |
| DE | 19516354 | A1 | 11/1996 |
| DE | 19822662 | A1 | 11/1999 |
| DE | 10103039 | A1 | 10/2002 |
| DE | 102007008392 | A1 | 10/2007 |
| EP | 0442322 | A1 | 8/1991 |
| JP | 7266547 | A | 10/1995 |
| JP | 2007216651 | A | 8/2007 |
| WO | 8100007 | | 1/1981 |

* cited by examiner

*Primary Examiner* — Jill Culler
*Assistant Examiner* — Leo T Hinze
(74) *Attorney, Agent, or Firm* — Laurence A. Greenberg; Werner H. Stemer; Ralph E. Locher

(57) ABSTRACT

A method for controlling inking units having a plurality of zones and/or dampening units in printing presses, includes determining reference values, which are dependent on surface area coverage and/or location, through the use of a computer for the inking zones in the inking unit. Deviations of detected color measuring values from the reference values are calculated for each inking zone. The calculated deviations are compared with data stored in the computer and corresponding with causes of color problems. The computer determines causes of color problems in the inking unit and/or dampening unit by comparison with the data.

8 Claims, 15 Drawing Sheets

METHOD FOR CONTROLLING INKING UNITS AND/OR DAMPENING UNITS

CROSS-REFERENCE TO RELATED APPLICATION

This application claims the priority, under 35 U.S.C. §119, of German Patent Application DE 10 2008 039 408.4, filed Aug. 22, 2008; the prior application is herewith incorporated by reference in its entirety.

BACKGROUND OF THE INVENTION

Field of the Invention

The present invention relates to a method for controlling inking units and/or dampening units in printing presses, in which the inking unit has a plurality of zones.

Offset printing presses have a plurality of printing units, in which each printing unit has an inking unit and a dampening unit. At least the inking units are usually divided into a plurality of zones as viewed over the entire printing width, with the result that an ink application can be metered in zones and color problems can thus be controlled out precisely. The zonal inking units are used, in particular, in sheet-fed offset printing presses. In order to achieve optimum ink metering, not only does the inking unit have to be set correctly in zones, but the dampening solution metering also has to be performed correctly. In addition, those two setting operations can be superimposed with further setting operations in the printing press. It is therefore not simple for the operator of a printing press to detect the causes of a possible faulty setting operation if the printed image does not supply the desired result.

SUMMARY OF THE INVENTION

It is accordingly an object of the invention to provide a method for controlling inking units and/or dampening units in printing presses, wherein the inking unit has a plurality of zones, which overcomes the hereinafore-mentioned disadvantages of the heretofore-known methods of this general type, with the result that the operator can readily determine the causes of color problems and corrective measures can optionally be proposed to him or her.

With the foregoing and other objects in view there is provided, in accordance with the invention, a method for controlling inking units having a plurality of zones and/or dampening units in printing presses. The method comprises determining reference values dependent on a surface area coverage and/or location with a computer for the inking zones in the inking unit, calculating deviations of detected color measuring values from the reference values for each inking zone, comparing the calculated deviations with data stored in the computer and corresponding with causes of color problems, and determining, with the computer, causes for color problems in the inking unit and/or dampening unit by comparison with the data.

The method according to the invention can be used both in sheet-fed offset printing presses and web-fed offset printing presses which have inking units with a plurality of inking zones. In this case, the method proceeds in interaction with a control computer of the printing press, a color measuring instrument and an adjusting device in the inking unit and dampening unit. First of all, reference values which are dependent on the surface area coverage are determined in the control computer for the inking zones. In principle, the reference values are determined on the basis of the actual zonal surface area coverage values and corresponding inking zone values, that is to say they are dependent on the location and surface area coverage. Color measured values which are expediently present for each inking zone are detected outside the printing press or on the printing materials which are produced in the printing press. The control computer then determines any deviations between the reference values and the detected color measured values, which deviations have to be controlled out. The control computer then compares the deviations calculated in this way with stored data which correspond with causes of color problems. The data can be stored, for example, in the form of curves. The causes for the color problems are determined by comparison of the calculated deviations with the data, with the result that the correct adjustments can be performed in the inking unit and/or dampening unit. The computer can also perform the adjustments automatically in the printing press.

If the stored data are deposited in the form of curves, the deviations which are calculated with regard to this likewise form a curve. For example, conclusions can be drawn about the color problem using the appearance of the curve. If this results in a horizontal compensating straight line, everything is in order. However, if this results in a tilted compensating straight line, more or less ink is applied to the paper on one side and, for example, the dampening unit roll has to be opened or squeezed on one side. If the result of the comparison of the curves is a bath tub shape, the pivoting of the dampening roll has to be corrected. In this way, the causes of color problems can be shown demonstrably and subjected to a corresponding correction.

In accordance with another mode of the invention, the data which correspond with the causes of the color problems are stored in a database, to which the computer is connected. The corresponding causes are stored in the database, for example, in conjunction with curves, which the control computer can compare with determined deviations, in order to thus take the causes of the deviations into consideration. The database therefore contains the trends which have been determined in conjunction with corresponding deviation values due to color problems which have occurred in the past. A plurality of printing press computers can then access the database. Moreover, the database can be expanded at any time with new knowledge about correlations between causes and deviations.

In accordance with a further mode of the invention, the causes which are determined for the color problems are displayed on a display apparatus. In this embodiment, first of all the cause for the color problem is displayed to the operator on a display screen, with the result that the operator himself or herself can make decisions about corresponding corrective measures. If the causes are not clear, a plurality of causes are indicated to the operator. Moreover, in one preferred embodiment, corresponding corrective measures are proposed which the operator can confirm and select by his or her input. In this way, the operator is relieved of the determination of causes for the color problems and the possible causes are restricted, with the result that the search for the causes of the color problems is simplified. In addition, corrective measures can be proposed, with the result that the operator only needs to select from the proposed corrective measures.

In accordance with an added mode of the invention, the reference values are to be determined by clustering of the opening values of the respective inking zones to be carried out in surface area coverage ranges with averaging. In general, there is a different surface area coverage value for each inking zone. In order for it to be possible to make a statistical statement, inking zones having similar surface area coverages are combined to form what are known as clusters. The regions for the clustering can be as desired, but the regions are preferably at the same spacing or are dependent on the sensitivity. In the case of identical spacings, for example, the surface area coverage range from 0 to 100 percent is divided into 10 parts. In this case, all of the surface area coverages from 0 to 10 percent, for example, are assigned to a 5 percent cluster, those from 11 to 20 percent are assigned to a 15 percent cluster, etc. However, in the extreme case, one cluster can also include the entire value range from 0 to 100 percent and there is then only one part. In the case of sensitivity-dependent clustering, more clearly pronounced dependencies are taken into consideration at low surface area coverages than in high surface area coverages. To this end, the clusters are narrower at low surface area coverages, and are wider at high surface area coverages. For instance, the values from 0 to 1 percent can be assigned to the one percent cluster, the values from 2 to 4 percent can be assigned to the 3 percent cluster, the values from 4 to 6 percent can be assigned to the 5 percent cluster, the values from 6 to 10 percent can be assigned to the 8 percent cluster, the values from 10 to 14 percent can be assigned to the 12 percent cluster, and the values from 15 to 21 percent can be assigned to the 18 percent cluster until, at the other end of the scale, the values from 80 to 100 percent are assigned to the 90 percent cluster. It can be seen that the clusters are narrower at low surface area coverages than at high surface area coverages.

In addition, it can also be appropriate to match the clustering to nodes of existing characteristic curves. If, for example, there are the inking presetting characteristic curves for 0, 1, 5, 10, 30, 70, 100 percent surface area coverage values, the clusters can be selected in such a way that they coincide with the nodes, that is to say there is the following cluster allocation: 0 to 0.5 percent is assigned to the 0 percent cluster, 0.5 to 2 percent is assigned to the 1 percent cluster, 2 to 7 percent is assigned to the 5 percent cluster, 7 to 20 percent is assigned to the 10 percent cluster, 20 to 50 percent is assigned to the 30 percent cluster, 50 to 80 percent is assigned to the 70 percent cluster, and 80 to 100 percent is assigned to the 100 percent cluster. In order to increase the accuracy of the calculation, a genuine mean value of all members of the cluster can also be used instead of the nominal cluster value. This brings about a situation where the clusters can be wider, without excessively great inaccuracies occurring due to the surface area coverage allocation. In addition, the values can be analyzed additionally within a cluster. A runaway value test can be performed, that is to say the values are tested for runaway values, with the result that measurement errors can be filtered out. In addition, standard deviations such as averaging can be applied to the values of a cluster. If there are sufficient values within a cluster in the standard deviation and if the standard deviation within a cluster is too high, this indicates printing problems.

In the case of averaging, a residual analysis can be carried out. In this case, residuals are to be understood as the deviations which result from the difference between an estimated value and an empirical value. This can also again take place in clusters. If there are enough values within a cluster, the deviation of the individual measured values from the mean value can be examined. This is substantially the standard deviation of the measured values within a cluster. If this standard deviation is very high, a more detailed analysis follows. If the deviation is spread statistically and there is no dependence of the deviations on the position on the sheet, this indicates the following problems. If the surface area coverage ranges do not show any peculiarities, the printing process is unstable and too much dampening solution is being received. If, in contrast, the dispersions occur due to sudden surface area coverage changes, it is to be assumed that the lateral distribution in the inking unit is not set correctly.

The residuals can be described satisfactorily through a function, for example as a straight line as a function of the inking zone. Furthermore, it is possible to carry out a residual analysis in relation to the printing material. Analogous processes as within a cluster are also applied in this case. In addition, the residuals can be combined either to form a virtual characteristic curve or to form the mean value of the individual clusters. There are statistical dispersions, large values indicating an unstable printing process. There are dispersions due to sudden surface area coverage changes within the printing form, which leads to a situation where, although there is no incorrect setting in the machine, learning of characteristic curves is only possible with great difficulty. If the residuals represent a function of the inking zones, there are corresponding faulty settings. If it is, for example, an oblique straight line, the dampening is too high on one side. If, instead, the function is a parabola, the dampening is too high or too low on both sides.

It goes without saying that these methods for determining the reference values and the subsequent analysis can also be combined with one another. In particular, the clustering of the aperture values of the respective inking zones and the determination of the reference values on the basis of a virtual inking presetting characteristic curve can be combined with one another. A virtual characteristic curve is to be understood as a characteristic curve, in which filtering or averaging has been performed. In order to make the system more robust, it is possible, moreover, that the filtering or averaging takes place over a plurality of print jobs or regulating steps. Subject-related problems can be separated from inking/dampening unit problems over the temporal course of several print jobs. Thus, for example, the lateral distribution in the inking unit, can be calculated through a discontinuity treatment.

In accordance with a concomitant mode of the invention, the deviations from the determined reference values are calculated for each inking zone as percentage aperture errors of the respective inking zone. In this case, the deviations from the determined reference values which are dependent on the surface area coverage for each inking zone are set not only as absolute values, but also in relation to the apertures of the respective inking zone. It can therefore be seen where particularly high percentage deviations occur.

Other features which are considered as characteristic for the invention are set forth in the appended claims.

Although the invention is illustrated and described herein as embodied in a method for controlling inking units and/or dampening units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
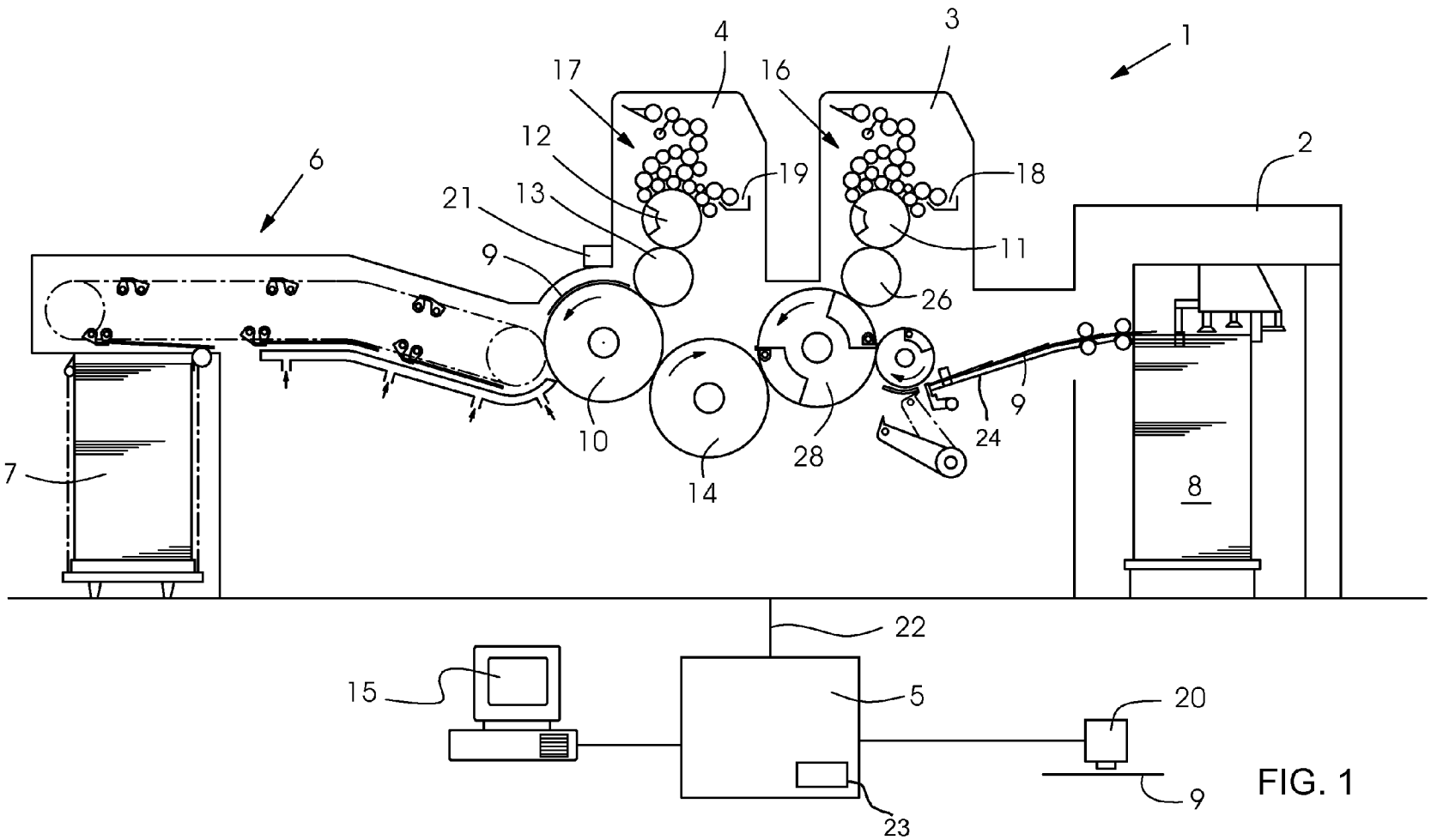
FIG. 1 is a diagrammatic, longitudinal-sectional view of a printing press having a control computer which is programmed according to the invention.

Referring now to the figures of the drawings in detail and first, particularly, to FIG. 1 thereof, there is seen a sheet-fed offset printing press 1 which, by way of example, has two printing units 3, 4. Each of the two printing units 3, 4 has an inking unit 16, 17 and a dampening unit 18, 19. In the inking units 16, 17, printing ink for printing is homogenized or equally spread over the entire printing unit width through numerous distributor rolls. Furthermore, dampening solution is fed in through the use of the dampening units 18, 19, in order for it to be possible to apply the correct ink consistency on a printing plate of plate cylinders 11, 12. In this case, ink fountains of the two inking units 16, 17 are configured in each case as zonal ink fountains, in which the number of inking zones in the ink fountains is dependent on the format of the machine. A sheet-fed offset printing press 1 having the format 70 cm×102 cm usually has 64 inking zones. The printing ink is transferred from the plate cylinders 11, 12 through blanket cylinders 13, 26 onto printing material 9 in a press nip between the blanket cylinders 13, 26 and impression cylinders 10, 28. The printing sheets 9 are fed to the printing units 3, 4 over a suction belt table 24 which connects a feeder 2 to the first printing unit 3. The sheets 9 are removed from a feeder stack 8 in the feeder 2. The sheets 9 are transported between the two printing units 3, 4 through the use of transport cylinders 14. After leaving the final printing unit 4, the sheets 9 are deposited on a delivery stack 7 in a delivery 6. An inline color measuring instrument 21 which, like an external color measuring instrument 20, is connected to a control computer 5 of the printing press 1 through a communications link 22, is situated at the outlet of the final printing unit 4. The control computer 5 controls drive motors and electric actuating assemblies of the printing press 1 and is connected to a display screen 15 for displaying the machine state and for operating the machine. Furthermore, the control computer 5 is connected to a database 23.

According to the present invention, reference values which are dependent on the surface area coverage are determined in the control computer 5 for the inking zones in the inking units 16, 17 using presetting. Color measured values are determined on the printed sheets 9 through the use of the color measuring instruments 21, 20 and are fed to the control computer 5. The control computer 5 then calculates the deviations between the detected color measured values and the reference values which are dependent on the surface area coverage. The deviations which are calculated in this way are compared in the control computer 5 with data which are stored in the database 23 and correspond with causes of color problems. The control computer 5 then determines the color problems by comparison with the data of the database 23 and optionally performs adjustments on the inking units 16, 17 and/or dampening units 18, 19.

Figure 2:
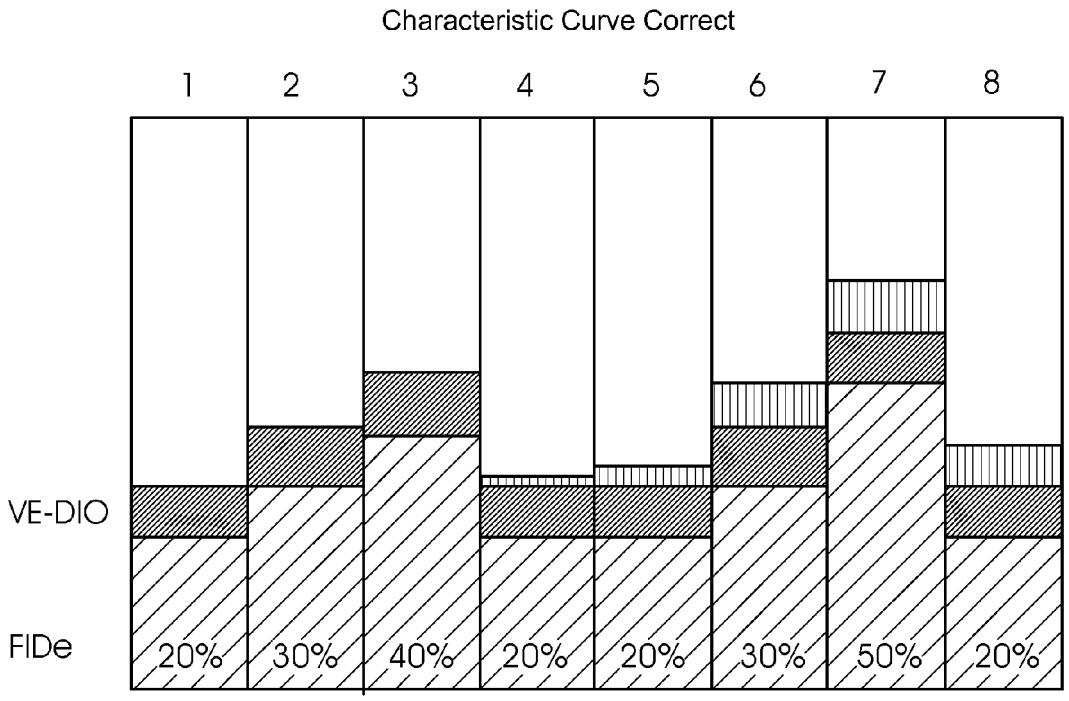
FIG. 2 is an illustration of a correctly set characteristic curve.
Figure 2A:
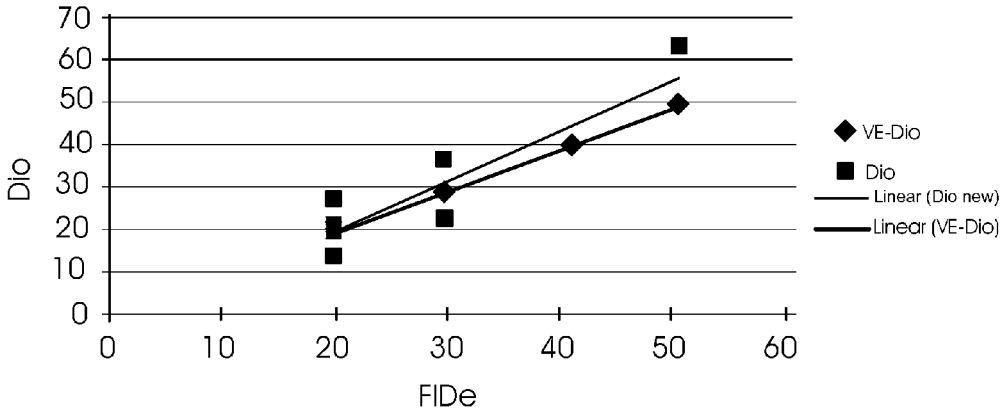
FIG. 2A is a graph showing a printed result, in which no interrelationship can be seen with a cause of defect.
Figure 2B:
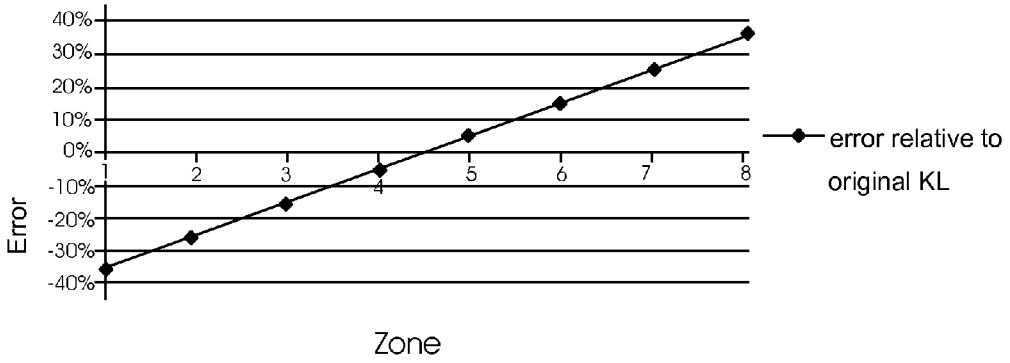
FIG. 2B is a graph showing a situation where there is an error with respect to the original characteristic curve.
Figure 2C:
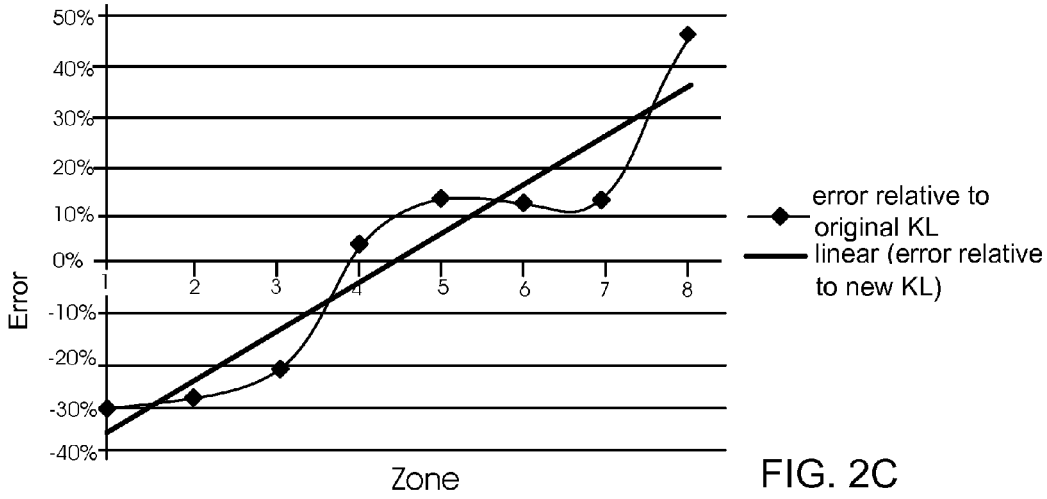
FIG. 2C is a graph showing a situation where there is an error with respect to a virtual characteristic curve.
Figure 2D:
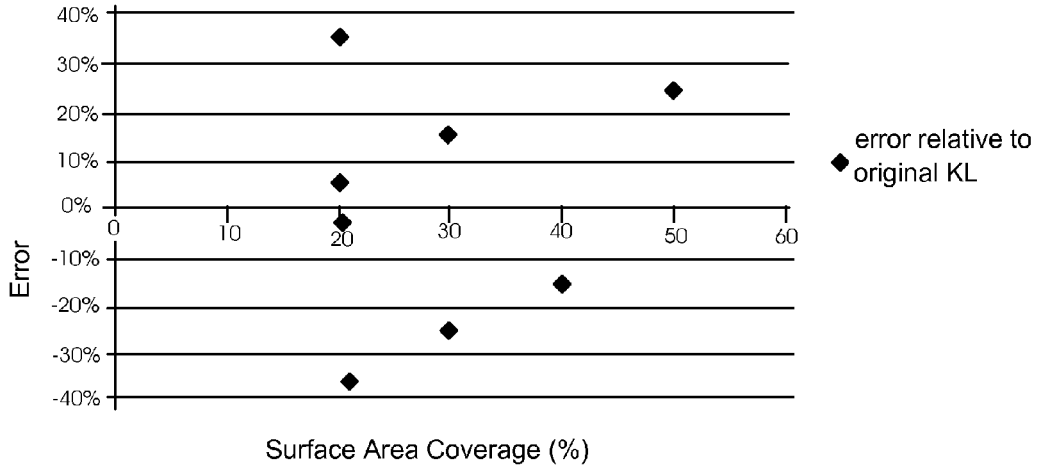
FIG. 2D is a graph showing a situation where there is no interrelationship.

FIG. 2 shows a first example of an analysis using a printing press 1 with 8 inking zones 1 to 8 in the inking units 16, 17. The surface area coverages FIDe are indicated in percent. In addition, the values of the inking zone setting of the ink presetting characteristic curve are specified in diodes VE-Dio. The ink presetting characteristic curve is set correctly. In a first tracking operation, the inking zone settings are changed in the perpendicularly hatched region. FIG. 2A shows a new illustration of the original ink presetting characteristic curve VE-DIO in comparison with the new characteristic curve DIO which is set after the first tracking operation. The straight lines are specified in the range of the surface area coverage FIDe for 20 to 50 percent. No error against the surface area coverage can be seen in FIG. 2A. In FIG. 2B, the error which results from FIG. 2A after the first tracking operation is plotted in percent in comparison with the original characteristic curve KL before the first tracking operation. It can be read from this that there is a rise in the ink density in the inking zones 1 to 8. In addition, FIG. 2C depicts the error after the first tracking operation in relation to a virtual characteristic curve. A rise in the ink densities from inking zone 1 to inking zone 8 can also be seen herein. FIG. 2D shows the error with regard to the original characteristic curve KL in percent plotted against the surface area coverage values in percent. No interrelationship can be seen from this. The control computer 5 can conclude from the four FIGS. 2A to 2D that, although the characteristic curve is in order, there is a dampening solution fountain or ink fountain problem. Furthermore, the control computer 5 can conclude due to the inclined straight lines in FIG. 2B that the inking unit is underinked on the right hand side, with the result that more ink has to be delivered, in order to compensate therefor. As a corrective measure, the control computer can reduce the dampening on the right hand side and open it further on the left hand side.

Figure 3:
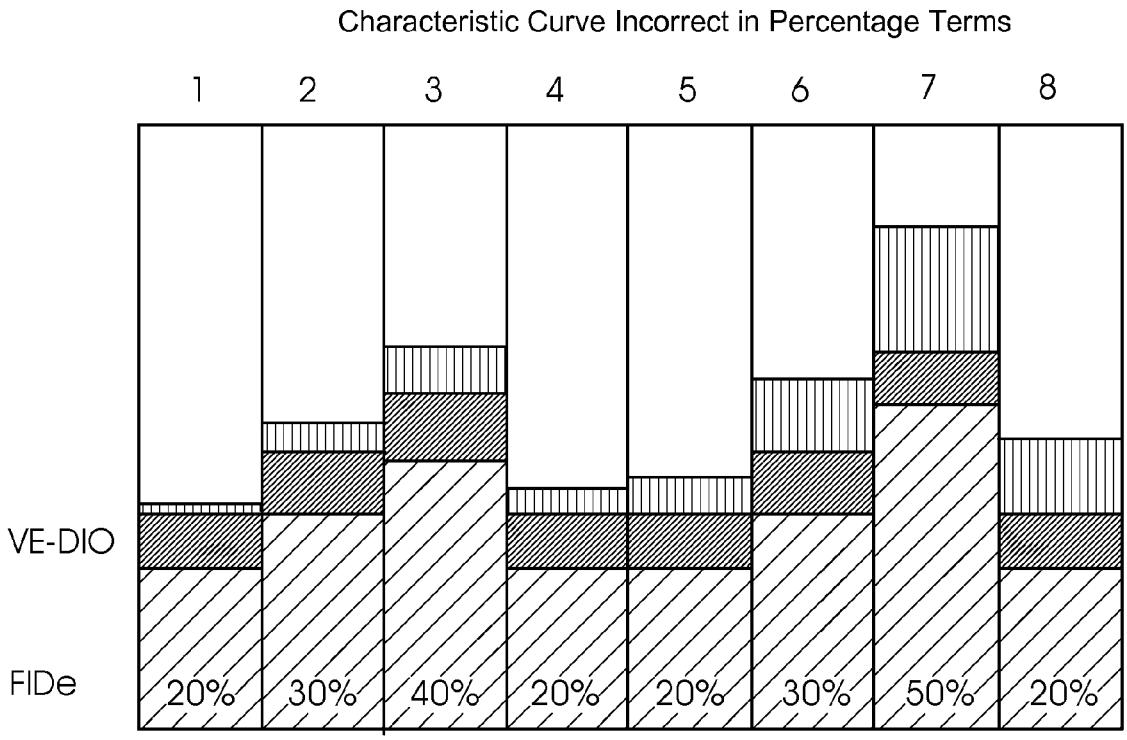
FIG. 3 is an illustration of a situation where the characteristic curve is incorrect in percentage terms.
Figure 3A:
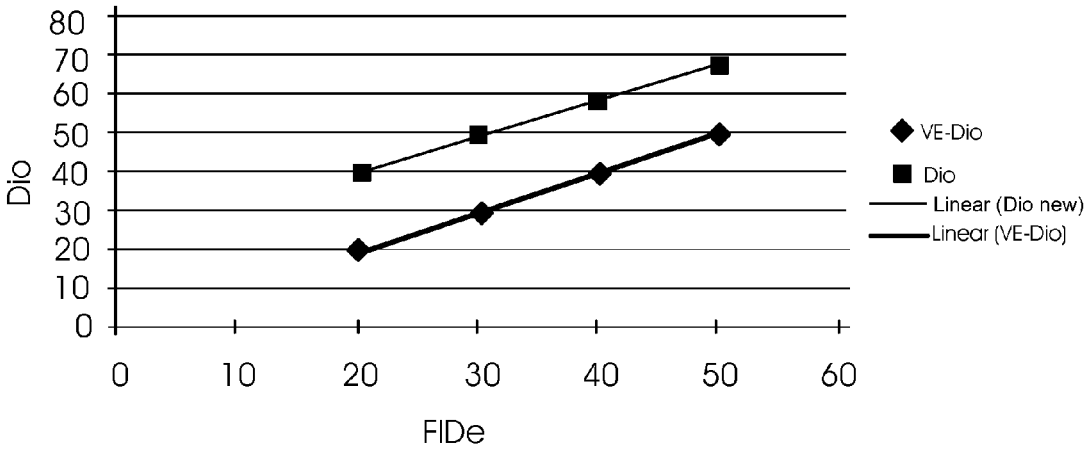
FIG. 3A is a graph showing a situation where there is a clear interrelationship in the case of an error plotted against the surface area coverage.
Figure 3B:
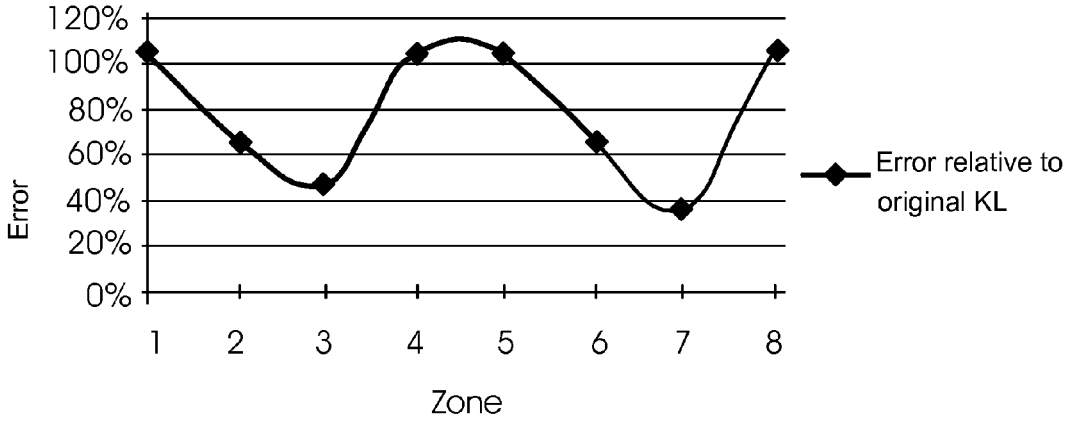
FIG. 3B is a graph showing a situation where there is an error with respect to the original characteristic curve.
Figure 3C:
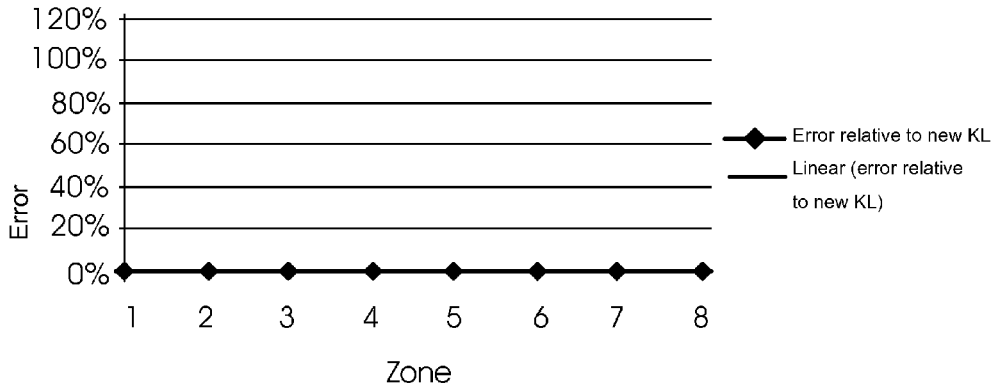
FIG. 3C is a graph showing a situation where there is an error with respect to the virtual characteristic curve.
Figure 3D:
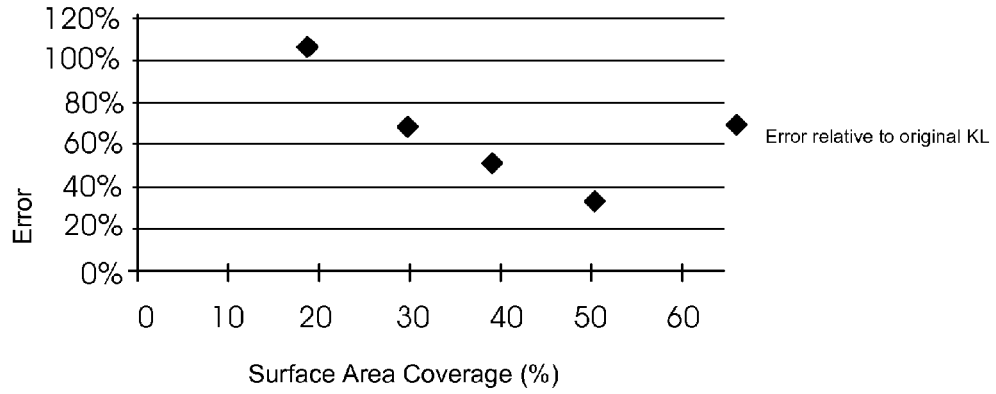
FIG. 3D is a graph showing a situation where there is a clear interrelationship of the error plotted against the surface area coverage.

A further example is apparent from FIG. 3. In this case, the ink presetting characteristic curve is set incorrectly in percentage terms. In FIG. 3, the surface area coverages FIDe in percent and the corresponding diode values VE-Dio are likewise plotted, with the perpendicularly hatched region once again representing the first tracking operation. FIG. 3A shows new drawings of the original characteristic curve VE-Dio and the new characteristic curve DIO. An error in relation to the surface area coverage can be determined unambiguously. In FIG. 3B, the error is plotted in comparison with the original characteristic curve KL before the first tracking operation. However, it is not possible to determine any unambiguous interrelationship in this case. FIG. 3C does not indicate any error with respect to a virtual characteristic curve. According to FIG. 3D, there is once again an unambiguous error in relation to the surface area coverage. The control computer concludes from the curves 3A to 3D that the characteristic curve is set incorrectly, but that otherwise the dampening unit 18, 19 and the inking unit 16, 17 are set correctly. In this case, the characteristic curve has to be relearned as a consequence.

Figure 4:
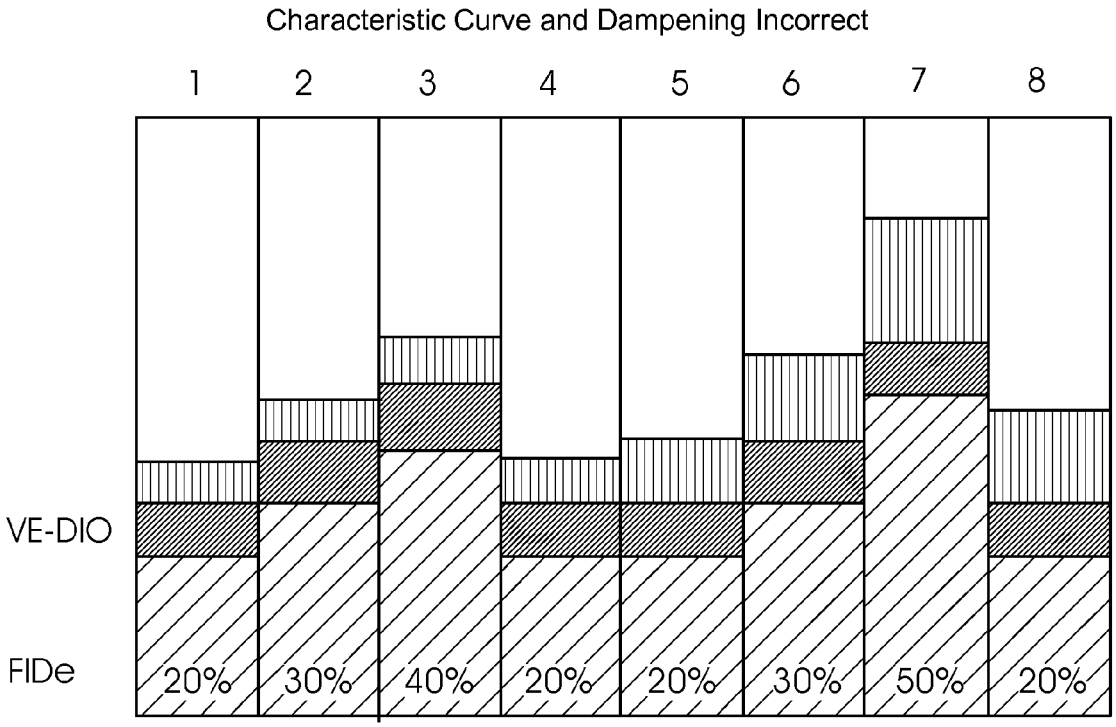
FIG. 4 is an illustration of showing a situation where the characteristic curve and the dampening solution metering are set incorrectly.
Figure 4A:
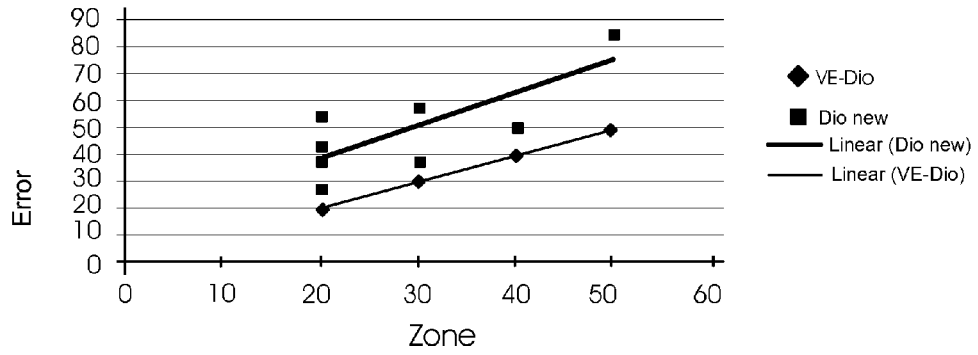
FIG. 4A is a graph showing a situation where there is a clear interrelationship of the errors in relation to the surface area coverage.
Figure 4B:
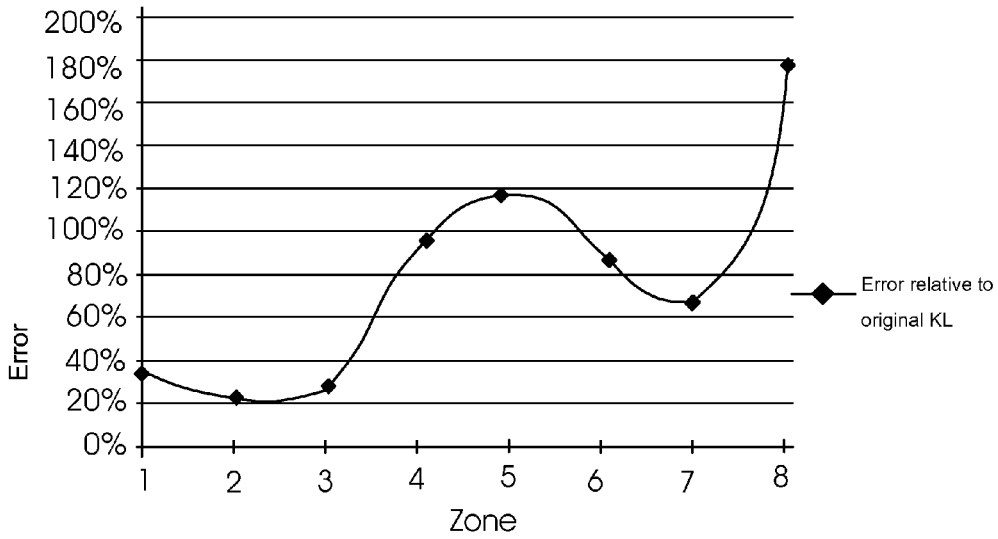
FIG. 4B is a graph showing a situation where there is an error with respect to the original characteristic curve.
Figure 4C:
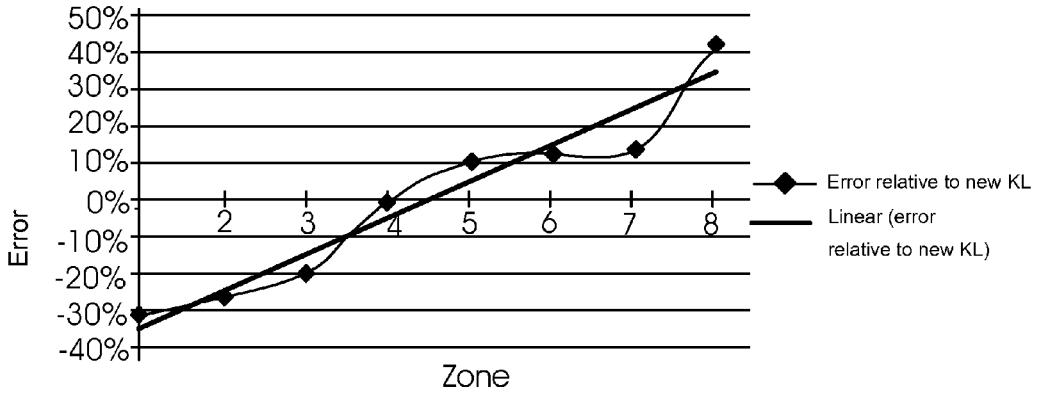
FIG. 4C is a graph showing a situation where there is an error with respect to the virtual characteristic curve.
Figure 4D:
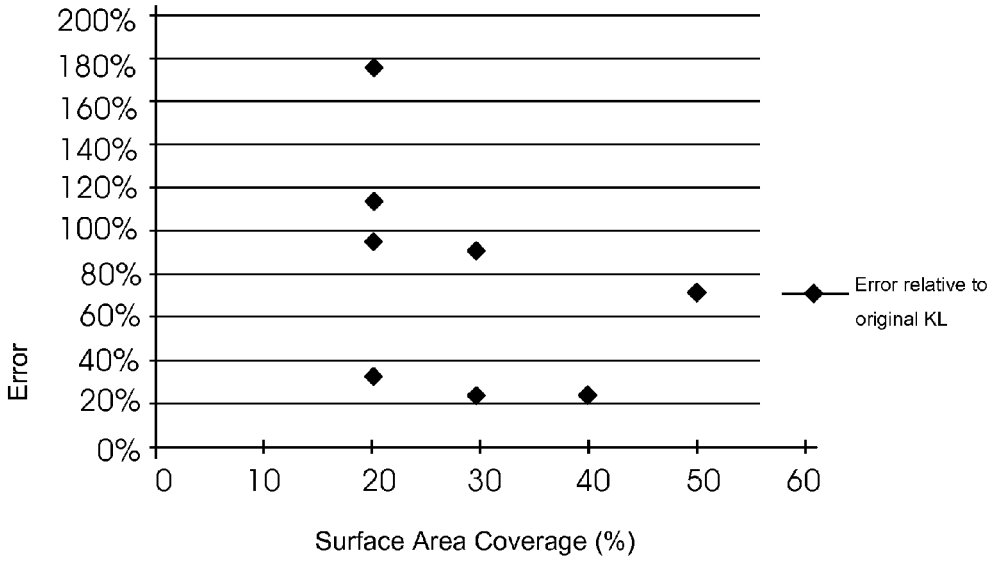
FIG. 4D is a graph showing a situation where there is a clear interrelationship of the errors with respect to the surface area coverage.

In the third example in FIG. 4, both the characteristic curve and the dampening solution metering are set incorrectly. After the first tracking operation which is once again illustrated in a perpendicularly hatched manner, the result according to FIGS. 4A and 4D is unambiguously an error in relation to the surface area coverage. No unambiguous error in relation to the original characteristic curve KL can be seen from FIG. 4B. Instead, the error analysis once again results in an unambiguous interrelationship with respect to the virtual characteristic curve KL in FIG. 4C. It can be concluded from these four curves that the characteristic curve is set incorrectly and, moreover, there is a problem in the dampening unit 18, 19 and in the inking unit 16, 17. In this case, the control computer 5 has to relearn the characteristic curve and the underinking on the right hand side has to be eliminated. To this end, the dampening solution metering has to be reduced on the right hand side or the dampening solution metering has to be increased on the left hand side.

Figure 5:
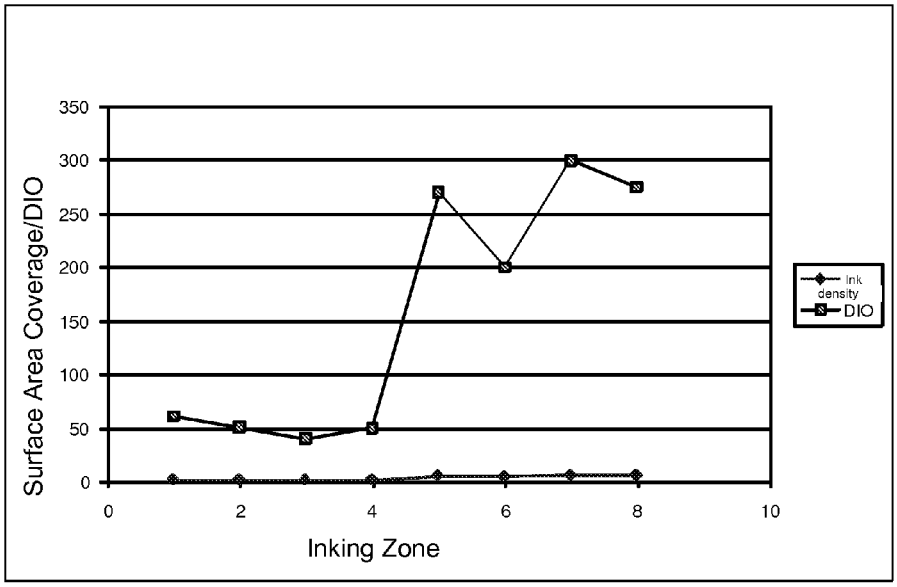
FIG. 5 is a graph showing the setting values of 8 inking zones of a printing press in relation to the surface area coverage in percent and in diodes on a setting scale.
Figure 5A:
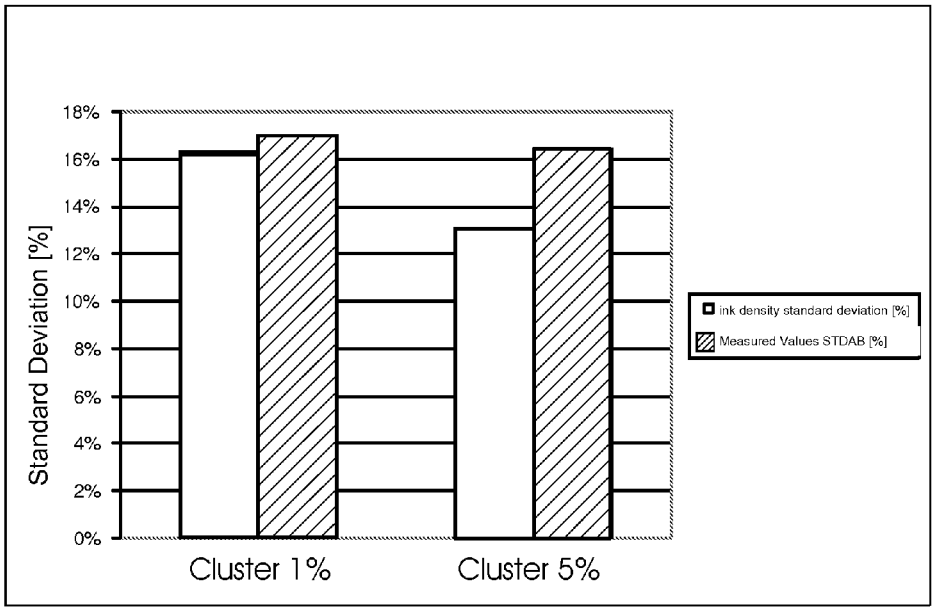
FIG. 5A is a graph showing clustering with a 1 percent cluster and a 5 percent cluster, and the standard deviation which results therefrom.

During the determination, in the control computer 5, of reference values which are dependent on the surface area coverage, the surface area coverage values FIDe are preferably clustered over a plurality of inking zones 1 to 8. A printing press 1 having 8 inking zones in the inking units 16, 17 is also shown herein by way of example. FIG. 5 depicts the initial situation of a first example, with the surface area coverage values being indicated in percent and in diode settings. According to FIG. 5A, clustering takes place into two clusters, a 1 percent cluster and a 5 percent cluster. To this end, FIG. 5A shows the standard deviation of the clustered surface area coverages FD as white bars and the standard deviation of the determined measured values as black bars.

Figure 6:
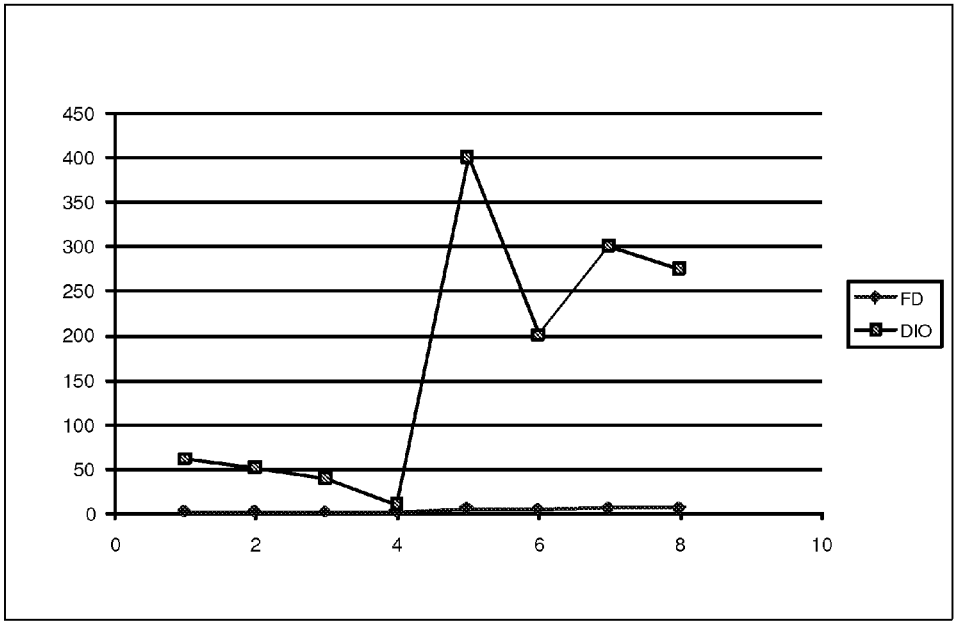
FIG. 6 is a graph showing a second setting of 8 inking zones in a printing press with the setting of the surface area coverage in percent and the associated diode values of a setting scale.
Figure 6A:
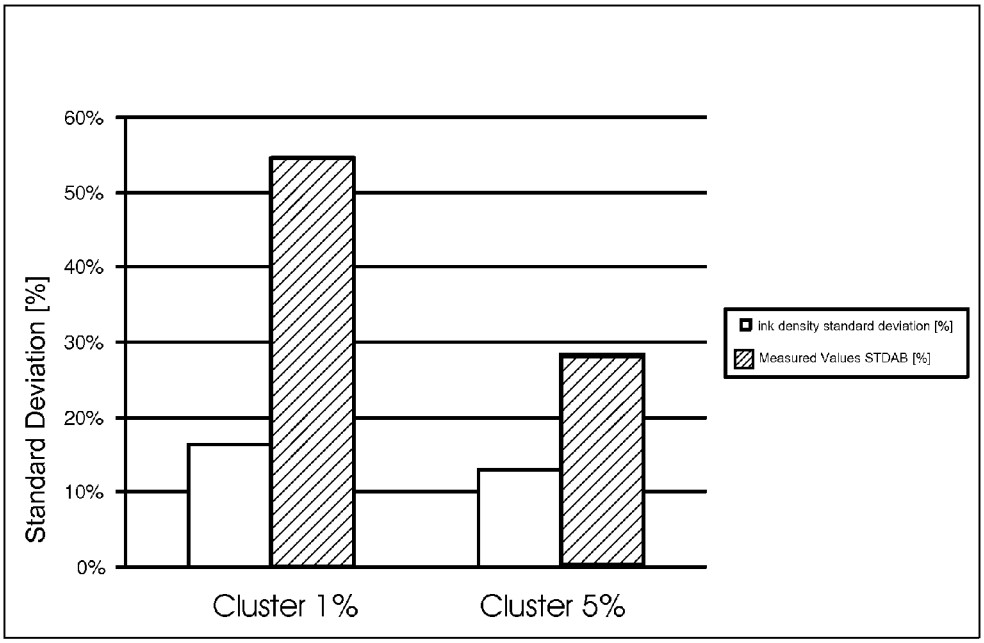
FIG. 6A once again is a graph showing an example for clustering in the form of a 1 percent cluster and a 5 percent cluster, and the standard deviation which results therefrom of the residuals within a cluster.

A second initial situation is apparent from FIG. 6. The surface area coverage values are also combined in this case to form 1 and 5 percent clusters, first of all with the deviations, residuals, according to FIG. 6B being determined by the determined reference values in clustered form and the measured values being determined in clustered form. FIG. 6A then shows the standard deviation of the surface area coverage values and the residuals in percent, that is to say the deviations between the measured values and the determined reference values.

Figure 6B:
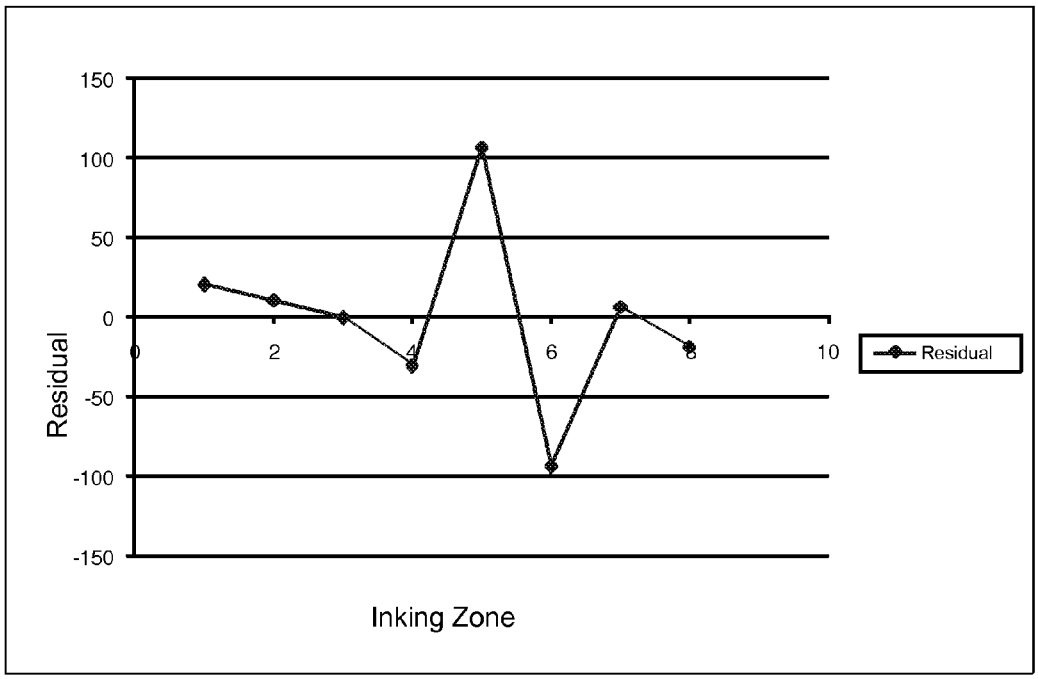
FIG. 6B is a graph showing the deviation of the residuals, within the clusters in 8 zones of a printing press.

FIG. 6B shows that the standard deviation within a cluster is very large. Moreover, the graphic in FIG. 6B shows that the values in the inking zones 4 and 5 at the sudden surface area coverage changes are the cause therefor.

Figure 7:
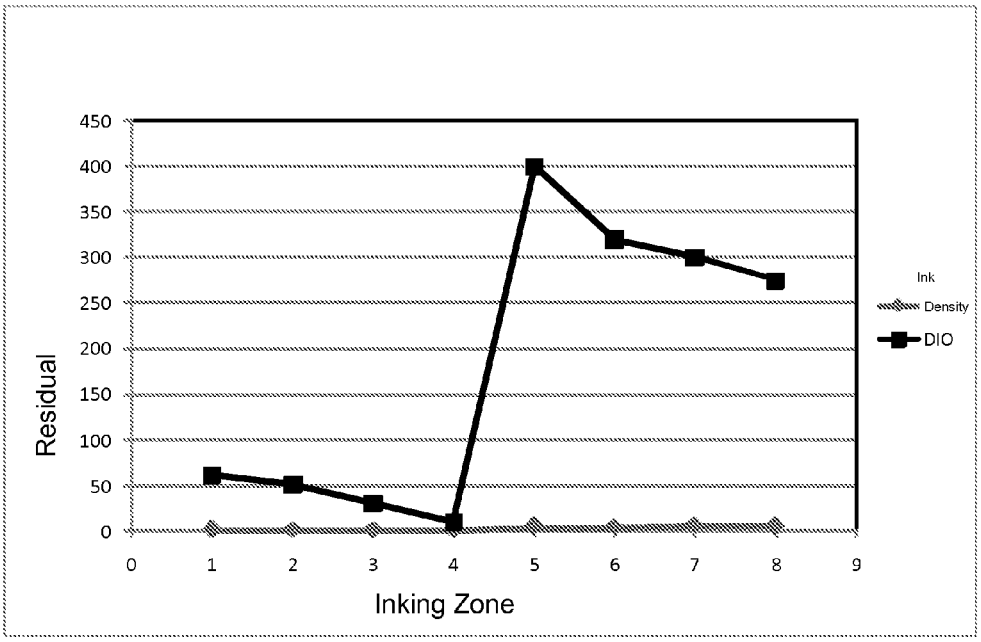
FIG. 7 is a graph showing a further setting of 8 inking zones of a printing press with surface area coverage values in percent and the associated diode settings of a setting scale.
Figure 7A:
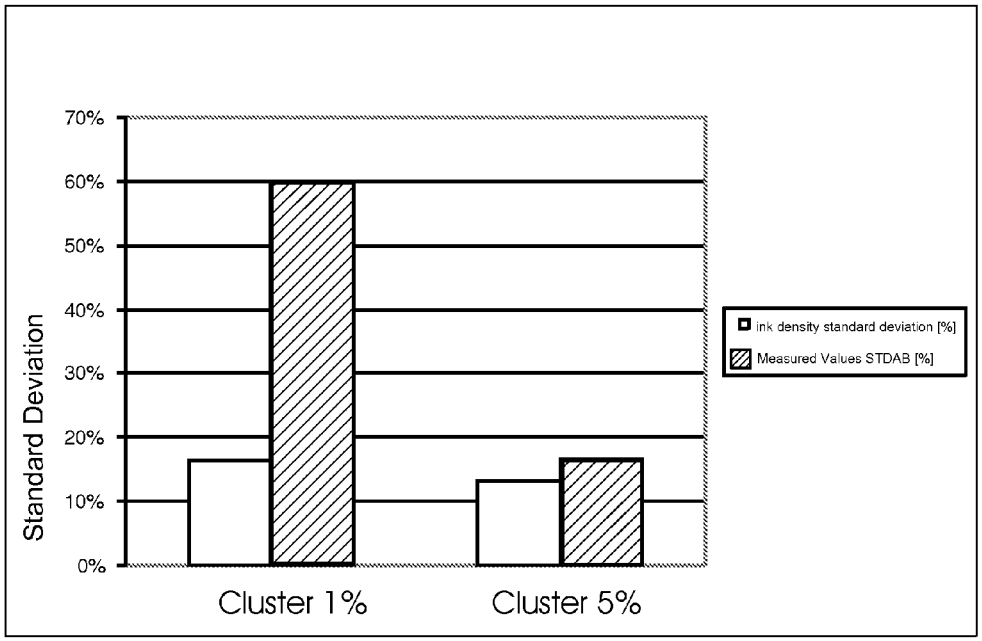
FIG. 7A is a graph showing the performance of clustering in 1 percent clusters and 5 percent clusters, and the standard deviation which results therefrom of the residuals within a cluster.
Figure 7B:
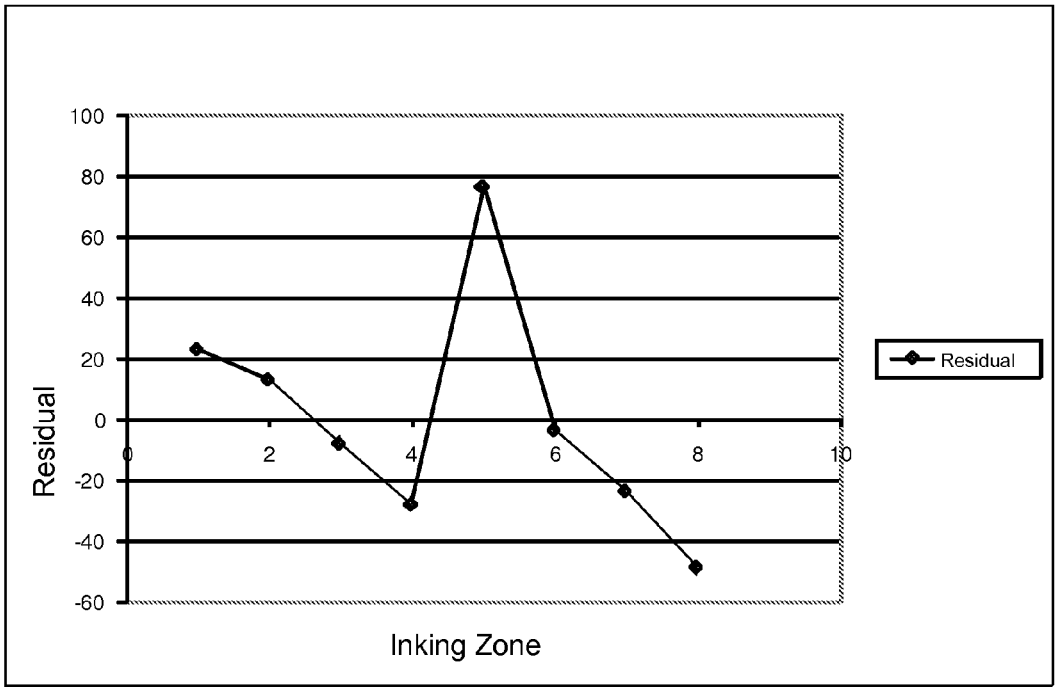
FIG. 7B is a graph showing the residuals plotted against the 8 inking zones of a printing press.

A third initial situation is apparent from FIG. 7. The surface area coverages are likewise plotted in this case in percent and in diodes. FIG. 7B in turn plots the residuals, that is to say the deviations of the clustered reference values, with respect to the measured values. It is shown that the standard deviation within a cluster is very large. Furthermore, a result of the analysis is that the residuals depend on the inking zone setting, since there is a considerable drop to higher inking zone values. In this case, the printing press 1 has more dampening solution in the case of high inking zones than in the case of low inking zones, and the dampening unit 18, 19 has to be adjusted correspondingly. FIG. 7A once again shows the standard deviation of the residuals within a cluster. It can be seen that the standard deviation of the residuals of the measured values is substantially lower in the 5 percent cluster than in the 1 percent cluster.

The invention claimed is:

1. A method for controlling inking units having a plurality of zones and/or dampening units in printing presses, the method comprising the following steps:

providing a printing press with a computer;

calculating reference values dependent on a surface area coverage and/or location based on presetting values with the computer for the inking zones in the inking unit;

producing printing material in the printing press and detecting color measuring values on the printing material with a color measuring instrument;

calculating deviations of detected color measuring values from the reference values for each inking zone with the computer;

storing the calculated deviations as data in the form of curves;

comparing, in the computer, the calculated deviations stored as data in the form of curves with stored data in the form of curves corresponding with causes of color problems; and determining, with the computer, causes for color problems in the inking unit and/or dampening unit by comparison between the stored curves of the calculated deviations and the stored curves corresponding to the color problems.

2. The method according to claim 1, which further comprises storing the data corresponding with the causes of the color problems in a database connected to the computer.

3. The method according to claim 1, which further comprises displaying the causes determined for the color problems on a display apparatus.

4. The method according to claim 1, which further comprises correcting the causes determined for the color problems, in the computer, by controlling printing press settings.

5. The method according to claim 1, which further comprises carrying out, with the computer, a learning operation of characteristic curves for setting the inking zones by storing the characteristic curves only when no color problems have been determined.

6. The method according to claim 1, which further comprises determining the reference values dependent on the surface area coverage and/or location by clustering aperture values of respective inking zones in surface area coverage ranges carried out by way of an averaging operation.

7. The method according to claim 1, which further comprises determining the reference values dependent on the surface area coverage and/or location on the basis of a virtual ink presetting characteristic curve.

8. The method according to claim 1, which further comprises carrying out a combination of:

determining the reference values dependent on the surface area coverage and/or location by clustering aperture values of respective inking zones in surface area coverage ranges carried out by way of an averaging operation, and determining the reference values dependent on the surface area coverage and/or location on the basis of a virtual ink presetting characteristic curve.

* * * * *